US007773928B2

(12) United States Patent
Ogiyama et al.

(10) Patent No.: US 7,773,928 B2
(45) Date of Patent: Aug. 10, 2010

(54) TRANSFER-SEPARATION DEVICE AND IMAGE FORMING APPARATUS

(75) Inventors: Hiromi Ogiyama, Tokyo (JP); Junroh Uda, Kanagawa (JP); Ryuuichi Mimbu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 59 days.

(21) Appl. No.: 11/743,254

(22) Filed: May 2, 2007

(65) Prior Publication Data

US 2007/0258737 A1 Nov. 8, 2007

(30) Foreign Application Priority Data

May 8, 2006 (JP) ..... 2006-129555
Jan. 12, 2007 (JP) ..... 2007-004711

(51) Int. Cl.
*G03G 15/14* (2006.01)

(52) U.S. Cl. ..... 399/315

(58) Field of Classification Search ..... 399/315, 399/310, 314, 101, 308
See application file for complete search history.

(56) References Cited

U.S. PATENT DOCUMENTS 5,198,863 A * 3/1993 Goto et al. ..... 399/314
5,250,357 A * 10/1993 Wilson et al. ..... 428/425.8
5,572,304 A * 11/1996 Seto et al. ..... 399/313
5,732,310 A * 3/1998 Hiroshima et al. ..... 399/101
5,834,116 A * 11/1998 Sawa et al. ..... 428/375
6,173,139 B1 * 1/2001 Takahata et al. ..... 399/107
6,559,210 B2 * 5/2003 Murata ..... 524/251
6,901,234 B2 5/2005 Ogiyama et al.
2003/0118359 A1 6/2003 Ogiyama et al.

(Continued)

FOREIGN PATENT DOCUMENTS

EP 0 856 783 A2 8/1998

(Continued)

OTHER PUBLICATIONS

Keithley Instruments, Inc, "Volume and Surface Resistivity Measurements of Insulating Materials Using the Model 6517A Electrometer/High Resistance Meter", Keithley Application Note Series HTTP://WWW.FOUR-POINT-PROBES.COM/VOLUME_SURFACE.PDF, XP002444898, No. 314, 2001, 4 pages.

(Continued)

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A transfer-separation device includes an intermediate transfer unit, a secondary transfer roller, a repulsive roller, a transfer unit, and a charge-eliminating/separating member. The secondary transfer roller and the repulsive roller form a nip through which the intermediate transfer unit and a recording medium pass. The transfer unit applies a bias voltage of a polarity identical to that of a toner image to the repulsive roller to secondarily transfer the toner image onto the recording medium. The charge-eliminating/separating member separates the recording medium from the intermediate transfer unit by removing charge therefrom. The volume resistance of the repulsive roller is greater than that of the secondary transfer roller. The surface resistance of the secondary transfer roller is equal to or greater than $10^{6.5}$ ohm.

8 Claims, 6 Drawing Sheets

U.S. PATENT DOCUMENTS

| | | | | |
|---|---|---|---|---|
| 2003/0219287 | A1 | 11/2003 | Ogiyama et al. | |
| 2004/0218941 | A1* | 11/2004 | Katsumi | 399/66 |
| 2004/0228659 | A1* | 11/2004 | Nishida | 399/176 |
| 2004/0265714 | A1* | 12/2004 | Miyakawa et al. | 430/45 |

FOREIGN PATENT DOCUMENTS

| | | |
|---|---|---|
| JP | 10-240028 | 9/1998 |
| JP | 2001-201954 | 7/2001 |
| JP | 2003-270971 | 9/2003 |
| JP | 2004-184875 | 7/2004 |
| JP | 2005-1863 | 1/2005 |
| JP | 2005-181863 | 7/2005 |
| WO | WO 2006115294 A1 * | 11/2006 |

OTHER PUBLICATIONS

William A. Maryniak, et al., "Surface Resistivity and Surface Resistance Measurements Using a Concentric Ring Probe Technique", Trek Application Note HTTP://WWW.TREKINC.COM/PDF/1005_RESISTIVITY_RESISTANCE.PDF, XP002444899, No. 1005, 2003, pp. 1-4.

Dr. Jaakko Paasi, "Surface resistance or surface resistivity?", Proceedinds Inet, XP002236314, Mar. 19, 2002, p. 1.

* cited by examiner

TRANSFER-SEPARATION DEVICE AND IMAGE FORMING APPARATUS

CROSS-REFERENCE TO RELATED APPLICATIONS

The present document incorporates by reference the entire contents of Japanese priority documents, 2006-129555 filed in Japan on May 8, 2006 and 2007-004711 filed in Japan on Jan. 12, 2007.

BACKGROUND OF THE INVENTION

1. Field of the Invention

The present invention relates to a transfer-separation device and an image forming apparatus.

2. Description of the Related Art

As a transfer device in an image forming apparatus, a device using an endless-belt-like intermediate transfer member (hereinafter, "intermediate transfer belt") has been known. In a color image forming apparatus, a device is widely used that primarily transfers toner images each having a different color onto the intermediate transfer belt from an image carrier such that toner images are sequentially superimposed one on top of the other to form a full-color image and performs secondarily transfers the full-color image onto a recording medium from the intermediate transfer belt.

As a transfer device using an intermediate transfer belt, a recording medium is sandwiched between the intermediate transfer belt and a secondary transfer roller, and a transfer bias (or a transfer current) having a polarity opposite to that of a toner image is applied to the secondary transfer roller to form a transfer electric field in a direction along which the toner image is attracted to a recording medium side between the recording medium and the intermediate transfer belt. A device that uses this transfer electric field to transfer the toner image onto the recording medium from the intermediate transfer belt is known. In this transfer device, a constant current having a polarity opposite to that of the toner image is supplied to the secondary transfer roller to obtain stable transfer performance with respect to irregularities in a resistance of the secondary transfer roller due to, e.g., a change in an environment. However, a resistance is greatly reduced due to a change in a moisture content of the recording medium in a high-humidity environment. Of the current supplied to the secondary transfer roller, a current that escapes to a carrying member that is in contact with the recording medium is largely increased via the recording medium. Therefore, of the current supplied to the secondary transfer roller, a current that contributes to forming a transfer electric field between the recording medium and the intermediate transfer belt is reduced, thus greatly decreasing transfer performance.

To solve such a problem, the present inventors have proposed, in Japanese Patent Application Laid-open No. 2004-184875, a transfer device and an image forming apparatus including the transfer device. The transfer device sandwiches a recording medium between an intermediate transfer belt and a secondary transfer roller, and has a secondary-transfer-opposed roller arranged on a rear surface of the intermediate transfer belt. A transfer bias having the same polarity as that of a toner image is applied to the secondary-transfer-opposed roller to transfer the toner image onto the recording medium from the intermediate transfer belt. In the conventional transfer device, a current having the same polarity as that of a toner image is supplied to the secondary-transfer-opposed roller provided on the rear surface of the intermediate transfer belt to form a transfer electric field in a direction along which the toner image recoils with respect to the intermediate transfer belt between the intermediate transfer belt and the recording medium. This transfer electric field is used to transfer the toner image onto the recording medium from the intermediate transfer belt. When the secondary-transfer-opposed roller is used to supply a constant current from the intermediate transfer belt side, even if a resistance of the recording medium is reduced due to fluctuations in an environment, the supplied current first forms a transfer electric field between the intermediate transfer belt and the recording medium, and then flows through the recording medium. Thus, the transfer electric field formed between the intermediate transfer belt and the recording medium hardly becomes under the influence due to a change in a resistance of the recording medium, and can be stably formed. Therefore, constantly stable transfer performance can be obtained.

In the conventional transfer device, the secondary-transfer-opposed roller applies a bias having the same polarity as that of the toner image, and transfers the toner image onto the recording medium from the intermediate transfer belt. Therefore, the secondary-transfer-opposed roller has a function as a repulsive roller. In this example, when a resistance of the secondary-transfer-opposed roller (repulsive roller) is increased and a resistance of the secondary transfer roller is set low, a current that leaks through the intermediate transfer belt is no longer present, and the current applied to the repulsive roller directly becomes a transfer current flowing toward the recording medium from the intermediate transfer belt, thus stabilizing a transfer ratio.

The present inventors have also proposed, in Japanese Patent Application Laid-open No. 2005-181863, a transfer-separation device and an image forming apparatus including the transfer-separation device. The transfer-separation device includes a charge-eliminating/separating device that eliminates charges from a recording medium and separates the recording medium from an intermediate transfer belt after secondary transfer. In the conventional transfer-separation device, when 0 microampere or a separation bias obtained by superimposing an alternating current (AC) on a constant-current-controlled direct current (DC) having a polarity opposite to that of a toner and a value far smaller than a secondary transfer bias is applied to a charge-eliminating/separating needle placed at a position closer to a secondary transfer roller than the intermediate transfer belt, an abnormal image due to discharge for separation/charge elimination can be avoided, and an interference of a current and a secondary transfer current due to discharge for separation/charge elimination can be suppressed. Accordingly, stabilizing a transfer ratio is stabilized.

In the former conventional technology, when a resistance of the secondary-transfer-opposed roller (repulsive roller) is increased and a resistance of the secondary transfer roller is set low, a current applied to the repulsive roller is prevented from leaking to, e.g., a roller that stretches the intermediate transfer belt through the intermediate transfer belt, and the current applied to the repulsive roller all becomes a transfer current flowing toward the recording medium from the intermediate transfer belt, thus obtaining a stable transfer ratio. In the latter conventional technology, a charge eliminating current discharged to the recording medium from the charge eliminating member, e.g., a charge eliminating needle does not affect a transfer current flowing toward the recording medium from the intermediate transfer belt. Accordingly, a stable transfer ratio can be achieved.

However, an electroconductive small foreign matter (e.g., a carbon fiber with a diameter of approximately 10 micrometers used for, e.g., a charge eliminating blush that is provided in a recording-medium conveying path in the image forming apparatus to eliminate charges from the recording medium) adhering to the recording medium is attached to, e.g., a high-resistance or an insulating guide plate provided between the charge eliminating member and the secondary transfer roller at on rare occasions. It can be considered that this phenomenon occurs since the foreign matter is drawn by an electric field that produces discharge from the charge eliminating member to the recording medium. An insulating resin or air alone is assumed to enter a space between the charge eliminating member and the secondary transfer roller. However, when the electroconductive foreign matter enters the space between the charge eliminating member and the secondary transfer roller, a spatial distance between the charge eliminating member and the secondary transfer roller is shortened at a position of the foreign matter alone, and an electric field in the space is increased. Therefore, abnormal discharge concentrated on the position of the foreign matter occurs, and a power supply that supplies a high voltage to the charge eliminating member abnormally stops. When the power supply is not rapidly subjected to abnormal stop, the small foreign matter is heated, and a peripheral insulating resin having the foreign matter adhering thereto may be eventually molten. Joule heat generation due to a flow of an abnormal discharge current through the foreign matter is considered as a cause of this phenomenon. When the apparatus abnormally stops or normally stops after continuation of an operation until the end and then abnormal discharge stops, the molten resin is cooled and again solidified. However, at this moment, the foreign matter is taken in and the resin is hardened. Therefore, the foreign matter is fixed in the resin and cannot be separated from the same. Then, abnormal discharge continuously occurs every time the apparatus operates.

When the foreign matter is fixed in the resin of the guide plate, maintenance of the apparatus cannot be completed simply by removal of the foreign matter based on a cleaning operation, and the molten member or a unit including this member must be discarded and replaced with a new one. Therefore, an operation time for maintenance is increased to raise a labor cost, and wastefully discarding an article leads to deterioration in an environment.

SUMMARY OF THE INVENTION

It is an object of the present invention to at least partially solve the problems in the conventional technology.

According to an aspect of the present invention, a transfer-separation device includes an intermediate transfer unit that is in a shape of an endless belt, onto which a toner image is primarily transferred from an image carrier, a secondary transfer roller that is in contact with a surface of the intermediate transfer unit where the toner image is carried via a recording medium, a repulsive roller that is located opposite to the secondary transfer roller and, with the secondary transfer roller, forms a secondary transfer nip through which the intermediate transfer unit and the recording medium pass, a transfer unit that applies a bias voltage of a polarity identical to a polarity of the toner image to the repulsive roller to generate a transfer electric field and secondarily transfers the toner image onto the recording medium, and a charge-eliminating and separating member that is located downstream of the secondary transfer nip in a conveying direction of the recording medium and eliminates charge from a surface of the recording medium to separate the recording medium from the intermediate transfer unit. The volume resistance of the repulsive roller is greater than the volume resistance of the secondary transfer roller, and the surface resistance of the secondary transfer roller is equal to or greater than $10^{6.5}$ ohm.

According to another aspect of the present invention, an image forming apparatus includes an image carrier that carries a toner image, and a transfer-separation device. The transfer-separation device includes an intermediate transfer unit that is in a shape of an endless belt, onto which a toner image is primarily transferred from the image carrier, a secondary transfer roller that is in contact with a surface of the intermediate transfer unit where the toner image is carried via a recording medium, a repulsive roller that is located opposite to the secondary transfer roller and, with the secondary transfer roller, forms a secondary transfer nip through which the intermediate transfer unit and the recording medium pass, a transfer unit that applies a bias voltage of a polarity identical to a polarity of the toner image to the repulsive roller to generate a transfer electric field and secondarily transfers the toner image onto the recording medium, and a charge-eliminating and separating member that is located downstream of the secondary transfer nip in a conveying direction of the recording medium and eliminates charge from a surface of the recording medium to separate the recording medium from the intermediate transfer unit. The volume resistance of the repulsive roller is greater than the volume resistance of the secondary transfer roller, and the surface resistance of the secondary transfer roller is equal to or greater than $10^{6.5}$ ohm.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. In the following description, the present invention is applied to a transfer-separation device in a color printer (hereinafter, "printer") as an image forming apparatus of a tandem intermediate transfer system.

Figure 1:
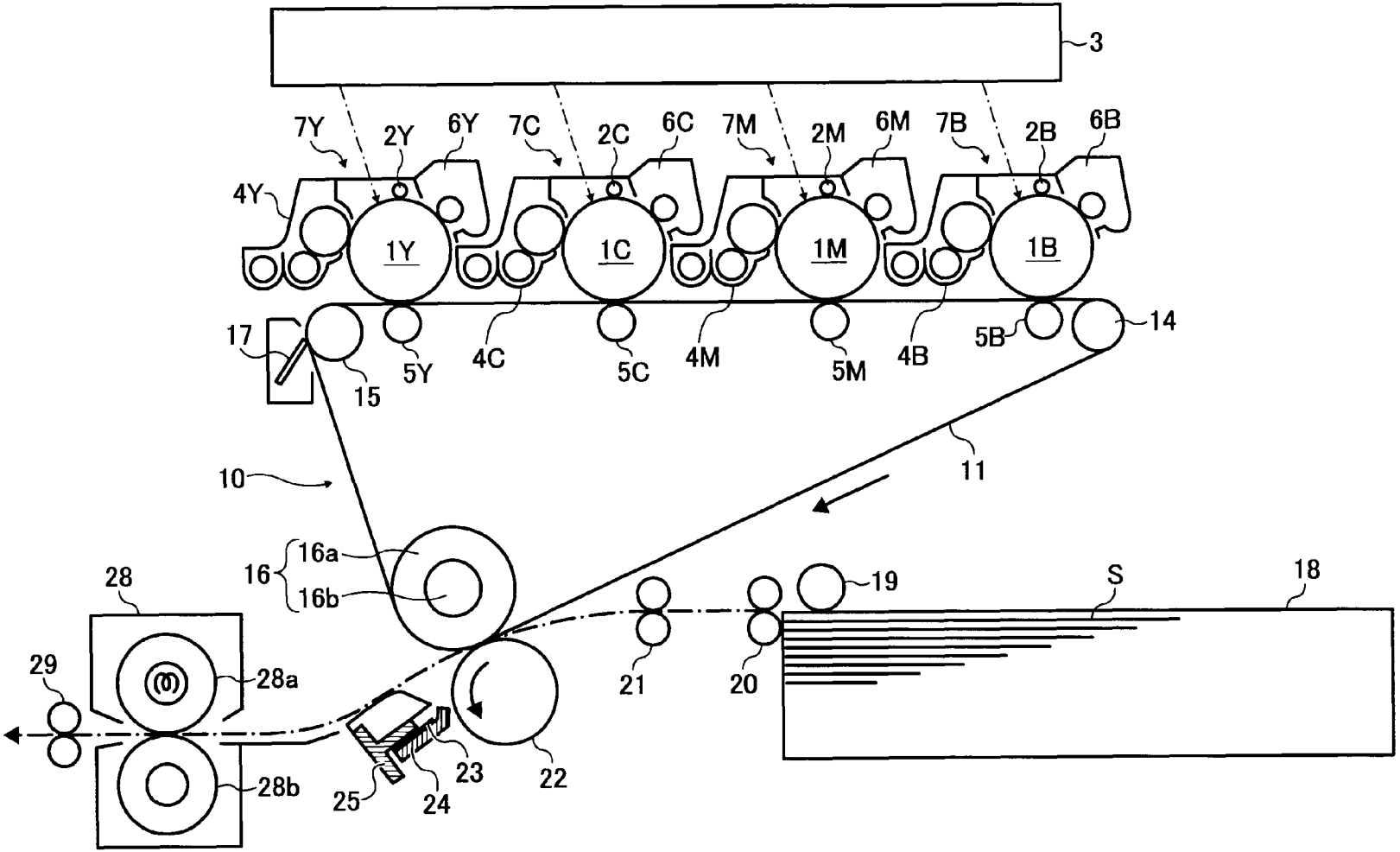
FIG. 1 is a schematic of relevant part of an image forming apparatus according to an embodiment of the present invention.

FIG. 1 is a schematic of relevant part of a printer according to an embodiment of the present invention. The printer includes four image forming units 7Y, 7C, 7M, and 7B of yellow (Y), cyan (C), magenta (M), and black (B) that constitute a tandem image forming unit. The image forming units 7Y, 7C, 7M, and 7B each serving as a toner image forming unit include chargers 2Y, 2C, 2M, and 2B, developing units 4Y, 4C, 4M, and 4B, photosensitive-drum cleaners 6Y, 6C, 6M, and 6B, and a charge eliminator (not shown) around photosensitive drums 1Y, 1C, 1M, and 1B as image carriers. These four colors are cited in this order by way of example and without limitation.

An exposure device 3 is provided above the tandem image forming unit. As the exposure device 3, there is, e.g., an exposure device adopting a light scanning mode that uses a light deflector, e.g., a polygon mirror to polarize and scan lights from four laser beam sources and performs exposure on the respective photosensitive drums 1Y, 1C, 1M, and 1B through four scanning/image forming optical systems to write electrostatic latent images, or a linear exposure device that have a light-emitting diode (LED) array and an image forming element array arranged in a main scanning direction and performs exposure of lights from the LED array on the respective photosensitive drums 1Y, 1C, 1M, and 1B to write electrostatic latent images.

A transfer-separation device 10 is arranged below the tandem image forming unit, and an endless-belt-like intermediate transfer belt 11 extending around a plurality of rollers is provided as an intermediate transfer member in the transfer-separation device 10. The intermediate transfer belt 11 extends around the rollers 14, 15, and 16, and a driving motor (not shown) as a driving source is coupled with a rotary shaft of the driving roller 14 in these rollers. When this driving motor is driven, the intermediate transfer belt 11 rotates and moves in a clockwise direction in the drawing, and the support roller 15 or the repulsive roller 16 that can be driven also rotates. The intermediate transfer belt 11 has semi-conductivity obtained by dispersing electroconductive particles of carbon or a metal complex in, e.g., polyimide (PI), polycarbonate (PC), a fluorine-based resin, or a silicon-based resin, and it is a belt formed of a single layer of these materials or a belt of a multilayer structure where these materials are superimposed. A volume resistance of the belt is $10^6$ ohm centimeters to $10^{12}$ ohm centimeters, and a surface resistance on a rear surface side of the intermediate transfer belt is $10^9$ Ω/□ to $10^{12}$ Ω/□.

Primary transfer devices 5Y, 5C, 5M, and 5B that perform primary transfer of toner images formed on the photosensitive drums 1Y, 1C, 1M, and 1B onto the intermediate transfer belt 11 are provided on an inner side (rear surface side) of the intermediate transfer belt 11.

Figure 2:
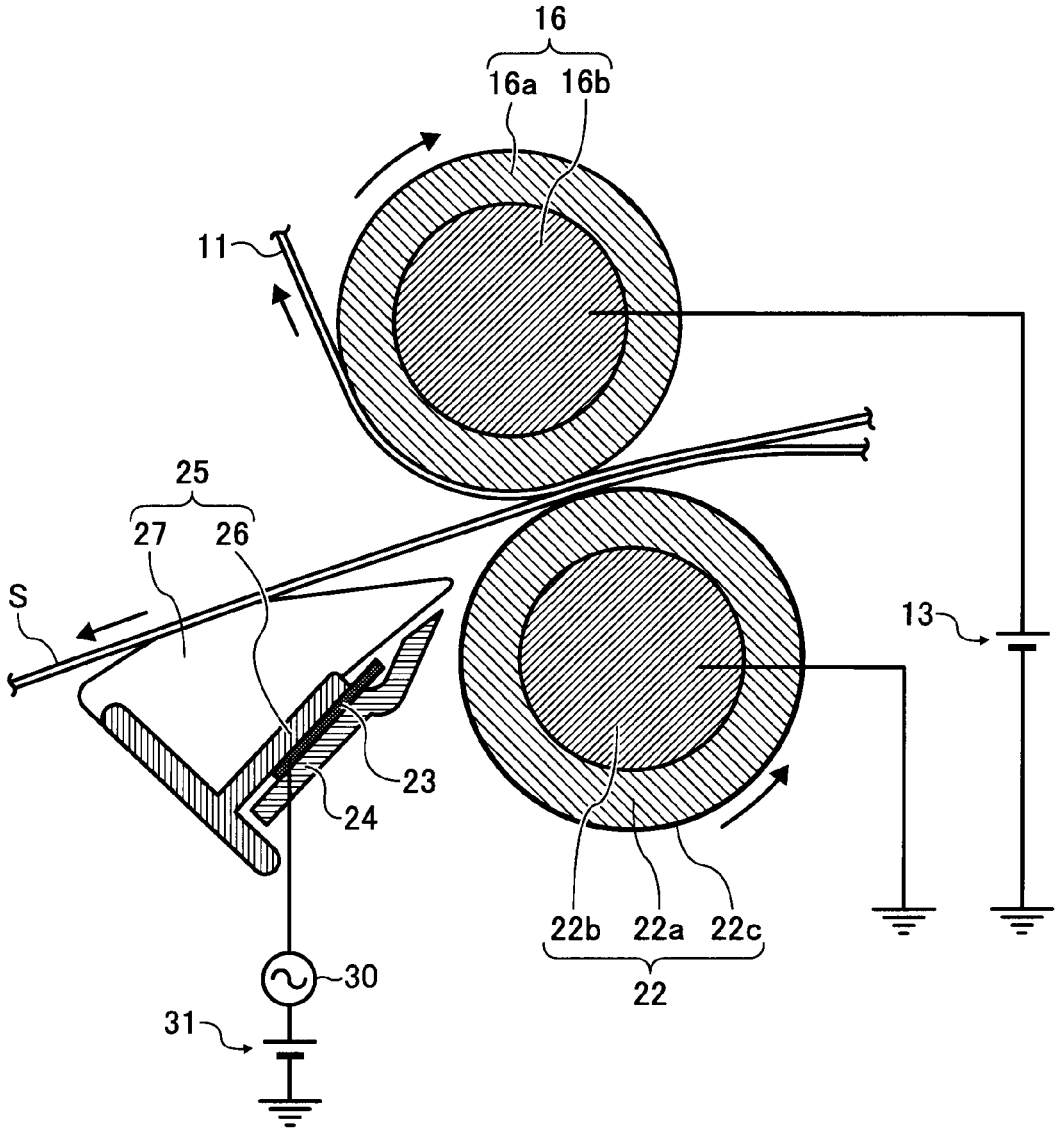
FIG. 2 is a cross section of a secondary transfer unit and a charge-eliminating/separating unit in a transfer-separation device shown in FIG. 1.

The repulsive roller 16 as a secondary-transfer-opposed roller is provided on the inner side (rear surface side) of the intermediate transfer belt 11 on a downstream side in a driving direction of the intermediate transfer belt 11 apart from the primary transfer positions. A secondary transfer roller 22 is provided at a position where this roller faces the repulsive roller 16 with the intermediate transfer belt 11 interposed therebetween. The secondary transfer roller 22 and the repulsive roller 16 sandwich the intermediate transfer belt 11 to form a secondary transfer nip. As shown in FIG. 2, a constant current power supply 13 that supplies a constant current having the same polarity as that of a toner image is connected with the repulsive roller 16, and the secondary transfer roller 22 is earthed.

A feed cassette 18 having recording media S, e.g., paper sheets mounted thereon, a feed roller 19 that feeds the recording media S one by one from the feed cassette 18, and separation rollers 20 are provided on an upstream side in a recording-medium conveying direction apart from the secondary transfer position. The recording medium S fed from the feed cassette 18 is conveyed to the secondary transfer nip by resist rollers 21 at a timing of arrival of a toner image transferred on the intermediate transfer belt 11 by an image forming and a primary transfer operations to a secondary transfer unit, and the toner image on the intermediate transfer belt 11 is secondarily transferred onto the recording medium S in the secondary transfer nip.

Along a traveling direction of the recoding medium S having the toner image transferred thereon by the secondary transfer roller 22, a charge-eliminating/separating needle 23 as a charge eliminating member of a charge-eliminating/separating unit that eliminates charges of the recording medium S having the toner image transferred thereon and separates the recording medium S from the intermediate transfer belt 11, and a guide member 25 that carries and guides the recording medium S separated from the intermediate transfer belt 11 are provided at a downstream side of the secondary transfer roller 22. A fixing device 28 including a fixing roller 28*a* that fixes the unfixed toner image on the recording medium S, a pressurizing roller 28*b*, and others, and paper ejection roller 29 that ejects the recording medium S after fixation to a paper ejection tray or a post-processor (not shown) are provided on a downstream side along the traveling direction of the separated recording medium S.

An operation of the printer is explained below. The respective image forming units each rotate corresponding one of the photosensitive drums 1Y, 1C, 1M, and 1B. The chargers 2Y, 2C, 2M, and 2B first uniformly charge surfaces of the photosensitive drums 1Y, 1C, 1M, and 1B with rotation of the photosensitive drums 1Y, 1C, 1M, and 1B. Then, writing light based on a laser beam or an LED beam from the exposure device 3 is applied according to image data, and electrostatic latent images are formed on the photosensitive drums 1Y, 1C, 1M, and 1B. Thereafter, the developing units 4Y, 4C, 4M, and 4B attach toners of the respective colors to visualize the electrostatic latent images into visible images, and monochromatic images of yellow (Y), cyan (C), magenta (M), and black (B) are formed on the respective photosensitive drums 1Y, 1C, 1M, and 1B. The driving motor (not shown) rotates and drives the driving roller 14 to allow the other driven roller 15 and the repulsive roller 16 to be driven so that the intermediate transfer belt 11 rotates. The primary transfer devices 5Y, 5C, 5M, and 5B sequentially transfer the visible images onto the intermediate transfer belt 11. As a result, a combined color image is formed on the intermediate transfer belt 11. The photosensitive-drum cleaners 6Y, 6C, 6M, and 6B remove and clean off the residual toners on the surfaces of the photosensitive drums 1Y, 1C, 1M, and 1B after image transfer, and the charge eliminator (not shown) eliminates charges on the surfaces of the photosensitive drums 1Y, 1C, 1M, and 1B to prepare for the next image formation.

The feed roller 19 and the separating rollers 20 feed each recording medium S from the feed cassette 18 at a timing of the image formation, thereby supplying the recording medium S to a space between the intermediate transfer belt 11 and the secondary transfer roller 22. The intermediate transfer belt 11 and the secondary transfer roller 22 form the secondary transfer nip through which the recording medium S passes, and supply a transfer current having the same polarity as that of the toner image as a secondary transfer bias to the repulsive roller 16. As a result, the toner image on the intermediate transfer belt 11 recoils from the intermediate transfer belt 11 to form a transfer electric field in a direction toward the recording medium S between the intermediate transfer belt 11 and the recording medium S. That is, the intermediate transfer belt 11 and a repulsive force of the toner image allow the toner image on the intermediate transfer belt 11 to be secondarily transferred onto the recording medium S.

The recording medium S after image transfer is supplied to the fixing device 28. The fixing roller 28*a* and the pressurizing roller 28*b* in the fixing device 28 apply heat and a pressure, thereby fixing the transferred image. The paper ejection roller 29 ejects the recording medium S subjected to fixation to a paper ejection tray or a post-processor (not shown) provided outside the device.

On the other hand, a cleaning device 17 removes the residual toner that remains on the intermediate transfer belt 11 after image transfer to prepare for the next image formation by the tandem image forming unit.

While, in the embodiment described above, the transfer-separation device is applied to a color printer of a tandem indirect transfer system is explained, the transfer-separation device can be similarly applied to other types of printers. For example, the transfer-separation device can be applied to a one-drum type color printer. In such a one-drum type color printer, a single photosensitive drum has four developing units of the respective colors Y, C, M, and B, and the single photosensitive drum sequentially and repeatedly performs formation, development, and primary transfer of a latent image onto an intermediate transfer belt. Toner images of all the colors are superimposed and transferred onto the intermediate transfer belt at a time, and then the images on the intermediate transfer belt are collectively secondarily transferred onto a recording medium S.

The image forming apparatus according to the embodiment is not necessarily a printer. When an image reading unit (scanner) is also provided in the structure of a printer, a function as a copier can be achieved. When such a printer is connected to a phone line or an optical cable to provide a communicating function, a function as a facsimile machine or a multifunction product can be achieved.

FIG. 2 is a cross section of the secondary transfer unit and the charge-eliminating/separating unit in the transfer-separation device 10. The repulsive roller 16 includes a resistance layer 16*a* and a core 16*b* made of stainless or aluminum. The resistance layer 16*a* is made of a material obtained by dispersing electroconductive particles of carbon or a metal complex in, e.g., polycarbonate, a fluorine-based rubber, or a silicon-based rubber, or a rubber, e.g., NBR or EPDM, or an NBR/ECO copolymer rubber, or a semi-conductive rubber of polyurethane. Its volume resistance is $10^6$ ohm to $10^{12}$ ohm, more preferably, $10^7$ ohm to $10^9$ ohm. Although both a foam type having hardness of 20 degrees to 50 degrees and a rubber type having rubber hardness of 30 degrees to 60 degrees can be used, since the resistance layer 16*a* comes into contact with the secondary transfer roller 22 through the intermediate transfer belt 11, a sponge type that does not produce a non-contact part even with a small contact pressure is desirable. That is because the sponge type can avoid a lack of a character or a thin line that is apt to occur when a contact pressure between the intermediate transfer belt 11 and the repulsive roller 16 is large.

The secondary transfer roller 22 is formed by superimposing a resistance layer (inner layer) 22*a* made of, e.g., an electroconductive rubber and a surface layer 22*c* on a core 22*b* made of stainless or aluminum. The secondary transfer roller 22 is formed to have a surface resistance (resistance between surfaces) larger than a volume resistance (resistance between the core and the surface). As shown in FIG. 2, when the resistance layer of the secondary transfer roller 22 is formed of two layers, i.e., the inner layer 22*a* and the surface layer 22*c*, the resistance layer is constituted in such a manner that a resistance of the surface layer 22*c* becomes higher than that of the inner layer 22*a*.

The charge-eliminating/separating unit that separates the recording medium S from the intermediate transfer belt 11 is provided near the secondary transfer roller 22 on the downstream side in the traveling direction of the recording medium S having the toner image transferred thereon by the secondary transfer roller 22. The charge-eliminating/separating unit has a structure where the charge-eliminating/separating needle 23 as a charge-eliminating/separating member is supported by the guide member 25 of an insulating resin component having a charge eliminating needle support member 26 and a guide rib 27 being integrated with each other. The charge-eliminating/separating needle 23 is made of a metal thin plate of, e.g., stainless, and cut into a shark-tooth-like shape at a pitch of several millimeters. The guide rib 27 is provided at a position apart from a tooth top so as not to obstruct discharge to the recording medium S from the charge-eliminating/separating needle 23.

Any one of alternating-current power supply 30 and a direct-current power supply 31 or both are connected as a separation bias applying unit to the charge-eliminating/separating needle 23. A bias is applied to the charge-eliminating/separating needle 23 to effect discharge from the tooth top, and a charge eliminating current is supplied to the recording medium S. As the bias to be applied, an AC bias, a DC bias, or a bias obtained by superimposing AC and DC is appropriately selected.

The structure where the separating position is not far from the transfer position is desirable to obtain excellent separating performance. Thus, reducing a distance between the charge-eliminating/separating needle 23 and the secondary transfer roller 22 is desirable. According to the method of supplying a current having the same polarity as the toner to the repulsive roller 16, the recording medium S between the intermediate transfer belt 11 and the charge-eliminating/separating needle 23 avoids interference between the transfer current and the charge eliminating current. Therefore, a discharge point can approximate the secondary transfer nip exit to advantageously obtain excellent separating performance and stable transfer performance. However, when a spatial distance between the discharge point and the secondary transfer nip exit is set to 1 kV/mm or below, abnormal discharge called leak or lightening discharge occurs. Therefore, there is a limit in reducing this distance. Thus, a resin guide member 24 as an insulating member is placed at a position close to the charge-eliminating/separating needle 23 and the secondary transfer roller 22 to increase the spatial distance and avoid occurrence of abnormal discharge.

When a distance between the discharge point and the intermediate transfer belt 11 is short, discharge outside a region where the recording medium S is present directly proceeds to the intermediate transfer belt 11 if a size of the recording medium S is smaller than that of the intermediate transfer belt. Then, the charge eliminating current and the secondary transfer current interfere with each other to affect a secondary transfer electric field. Thus, the spatial distance between the discharge point of the charge-eliminating/separating needle 23 and the intermediate transfer belt 11 is set to be longer than the spatial distance between the discharge point of the charge-eliminating/separating needle 23 and the secondary transfer roller 22. When this structure is adopted, even if the size of the recording medium S is small and the region without the recording medium S is present between the intermediate transfer belt 11 and the charge-eliminating/separating needle 23, the charge-eliminating/separating needle 23 discharges electricity from the intermediate transfer belt 11 toward the secondary transfer roller 22 having the short spatial distance in this region, thereby reducing a ratio of discharging electricity toward the intermediate transfer belt 11. That is, when the current based on discharge of the charge-eliminating/separating needle 23 is distributed to the secondary transfer roller 22, the charge eliminating current flowing through the intermediate transfer belt 11 is decreased. Therefore, the interference of the charge eliminating current with respect to the transfer current can be suppressed to acquire stable transfer performance.

In the transfer-separation device having the structure shown in FIG. 2, the current applied to the repulsive roller 16 does not leak to, e.g., the rollers around which the intermediate transfer belt 11 is wound through the intermediate transfer belt 11, and the current applied to the repulsive roller 16 all becomes the transfer current flowing toward the recording medium S from the intermediate transfer belt 11, thus obtaining a stable transfer ratio. The charge eliminating current discharged from the charge-eliminating/separating needle 23 toward the recording medium S does not affect the transfer current flowing toward the recording medium S from the intermediate transfer belt 11, and hence a stable transfer ratio can be obtained.

Figure 3:
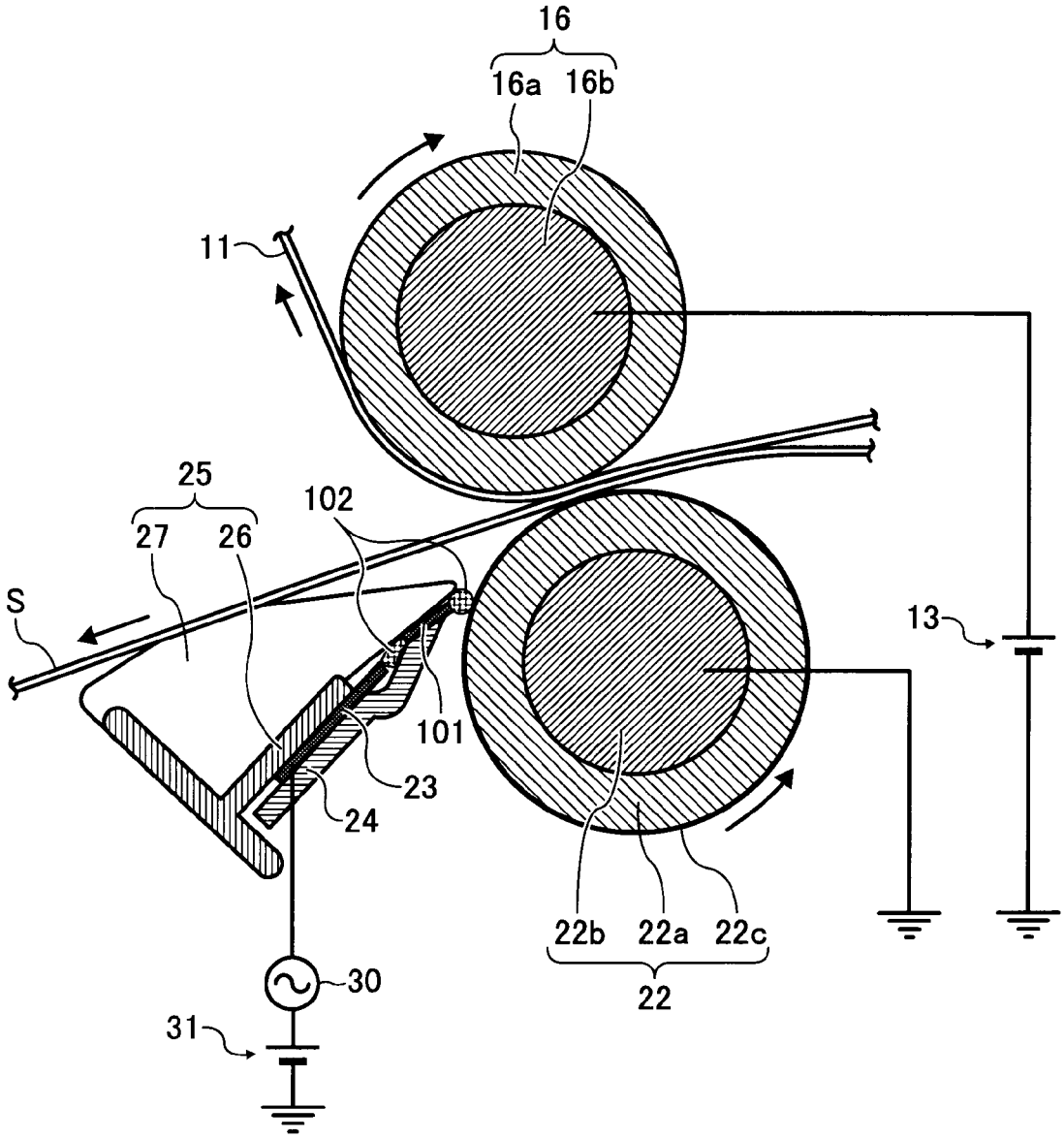
FIG. 3 is a cross section of the charge-eliminating/separating unit in which foreign matter enters and abnormal discharge occurs.
Figure 7:
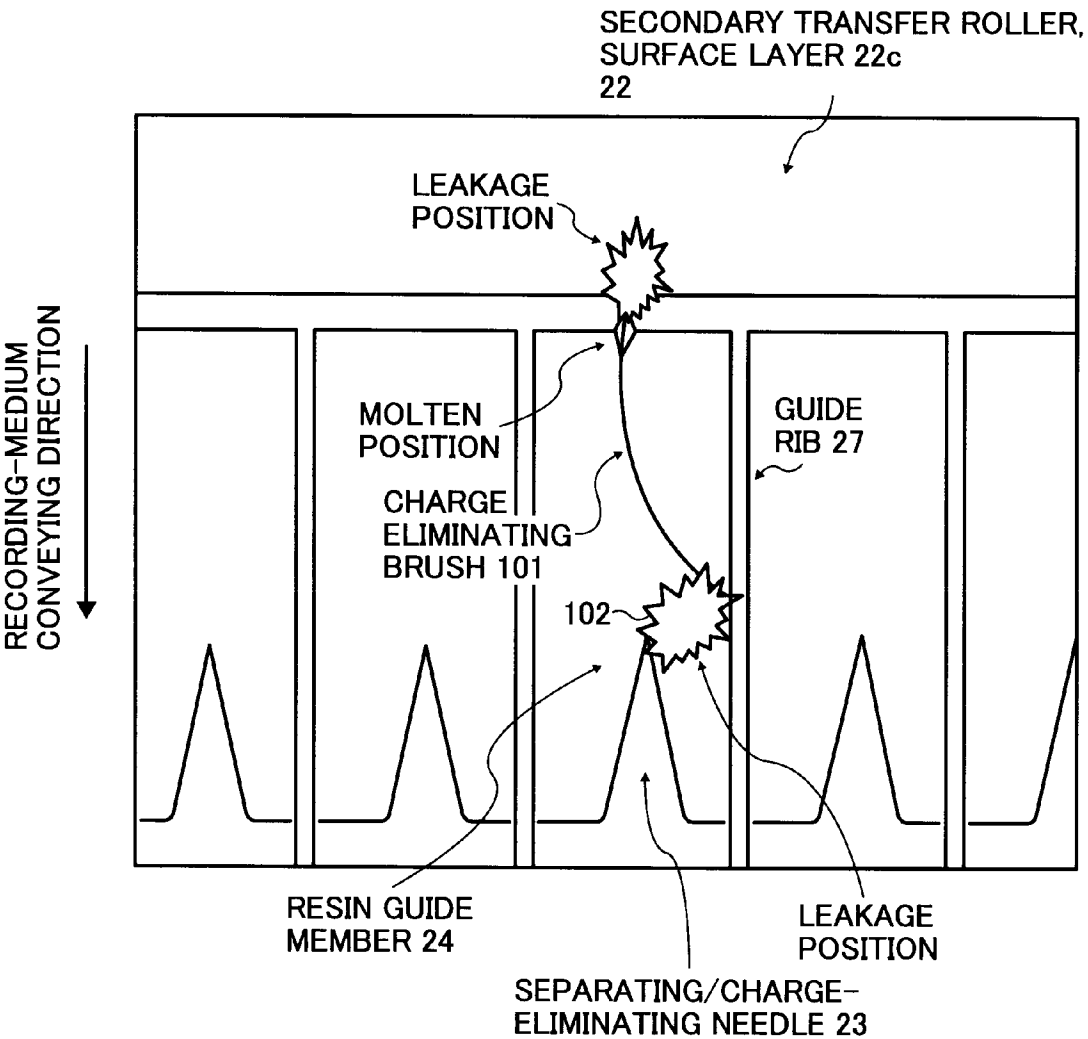
FIG. 7 is an overhead view of a leakage position and a position where the foreign matter (charge eliminating brush) contacts near a charge-eliminating/separating needle in the charge-eliminating/separating unit shown in FIG. 3 without a recording medium.

Meanwhile, an electroconductive small foreign matter (e.g., a carbon fiber having a diameter of approximately 10 micrometers used for, e.g., a charge eliminating brush placed in a recording-medium conveying path in the image forming apparatus to eliminate charges from the recording medium) adhering to the recording medium S is attached to the high-resistance or the insulating guide members 24 and 25 between the charge-eliminating/separating needle 23 and the secondary transfer roller 22 for the rare occasion as shown in FIG. 3. That is because this foreign matter is considered to be drawn by an electric field that produces discharge from the charge-eliminating/separating needle 23 to the recording medium S. An insulating resin or air alone is assumed to enter a space between the charge-eliminating/separating needle 23 and the secondary transfer roller 22. However, when an electroconductive foreign matter (e.g., a charge eliminating brush made of a carbon fiber) 101 enters the space between the charge-eliminating/separating needle 23 and the secondary transfer roller 22, the spatial distance between the charge-eliminating/separating needle 23 and the secondary transfer roller 22 is shortened at a position of the foreign matter (charge eliminating brush) 101 alone, and an electric field in the space is increased. Therefore, abnormal discharge (leak) concentrated on the position of the foreign matter 101 occurs. FIG. 7 is an overhead view of a leakage position and a position where the foreign matter (charge eliminating brush) 101 in the charge-eliminating/separating unit shown in FIG. 3 without a recording medium. In FIG. 7, abnormal discharge (leak) occurs between a distal end of the entrained foreign matter (charge eliminating brush) 101 and the guide rib 27 or the charge-eliminating/separating needle 23 and a flash 102 occurs with this discharge. When such abnormal discharge (leak) occurs, the power supply 30 or 31 that supplies a high voltage to the charge-eliminating/separating needle 23 abnormally stops. When the power supply does not rapidly come to an abnormal stop, the small foreign particle is heated. A cause of this heating can be considered as Joule heat generation due to a flow of an abnormal discharge current through the foreign matter 101. Then, the peripheral insulating resin to which the foreign matter adheres may be molten in some cases. Thereafter, when the apparatus comes to an abnormal stop after meltdown or continues the operation till the end to normally stop, abnormal discharged is stopped. Then, the molten resin is cooled and again solidified. However, the resin is solidified with the foreign matter contained therein, and hence the foreign matter is fixed in the resin and cannot be detached from the same. Then, abnormal discharge continues every time the apparatus operates.

When the foreign matter 101 is fixed in the resin constituting the guide members 24 and 25, maintenance cannot be completed simply by removable of the foreign matter in a cleaning operation, and the molten member or a unit including this member must be discarded and replaced with the new one. Therefore, a maintenance operation time is increased to raise a labor charge, and wastefully discarding articles leads to deterioration in an environment.

Thus, in the transfer-separation device 10 according to the embodiment, even if an electroconductive small foreign matter adhering to the recording medium S is attached to the high-resistance or the insulating guide members 24 and 25 between the charge-eliminating/separating needle 23 and the secondary transfer roller 22, abnormal discharge does not occur at all, or abnormal discharge is suppressed to the minimum level even if it occurs.

As a unit that avoids abnormal discharge, the secondary transfer roller 22 is configured to have a surface resistance (resistance between the surfaces) larger than a volume resistance (resistance between a shaft and the surface). Alternatively, the resistance layer of the secondary transfer roller 22 is made up of at least two layers, and the resistance layer is configured in such a manner that a resistance of the surface layer 22*c* is higher than that of the inner layer 22*a*. In other words, the secondary transfer roller 22 has a structure where a resistance of the surface layer unit is higher than a volume resistance. When such a structure is adopted, even though the electroconductive small foreign matter 101 adhering to the recording medium S is attached to the high-resistance or the insulating guide members 24 and 25 provided between the charge-eliminating/separating needle 23 and the secondary transfer roller 22, abnormal discharge does not occur between the charge-eliminating/separating needle 23 and the secondary transfer roller 22 at all, or abnormal discharge can be suppressed to the minimum level even if it occurs. As a result, the power supply 30 or 31 that supplies a high voltage to the charge-eliminating/separating needle 23 can be prevented from coming to an abnormal stop, or the foreign matter can be prevented from being fixed in the resin of the guide members 24 and 25.

EXAMPLES

Specific examples of the embodiment are explained below.

It is assumed that an image forming apparatus (printer) has the same configuration as described in connection with FIG. 1. A positional relationship between the repulsive roller 16, the intermediate transfer belt 11, the secondary transfer roller 22, and the charge-eliminating/separating needle 23 constituting the transfer-separation device 10 and application mode of secondary transfer bias and separation bias are the same as previously described in connection with FIG. 2. A process speed of the printer is 252 mm/s.

The repulsive roller 16 has an external diameter of 24 millimeters and a diameter of 16 millimeters, includes the stainless core 16*b* and the medium-resistance layer 16*a* of an NBR/ECO copolymer rubber, and has a volume resistance (resistance between the core and the surface) of $10^{7.8}$ ohm.

A material of the intermediate transfer belt 11 is a PI single layer, and has a thickness of 60 micrometers to 80 micrometers, a surface resistance of $10^{10.5}$ Ω/□ on both a front surface and a rear surface, and a volume resistance of $10^{8.5}$ ohm centimeters.

As a secondary transfer bias, a current having the same polarity as that of a toner image is applied to the core 16*b* of the repulsive roller 16 under constant current control. For example, a transfer current is determined as −20 microamperes to −40 microamperes.

As a separation bias, 0 microampere or a bias obtained by superimposing a constant-voltage-controlled AC having a sine wave with a peak-to-peak value of 8 kV·1 kHz to 12 kV·1 kHz on a constant-current-controlled DC that has a polarity opposite to that of a toner and a value far smaller than that of the secondary transfer bias is applied to the charge-eliminating/separating needle 23.

A relationship between resistance of the resistance layer 22*a* and the surface layer 22*c* of the secondary transfer roller 22 and presence/absence of abnormal discharge is explained with reference to FIG. 3.

The external diameter of the secondary transfer roller 22 is 24 millimeters, and the core 22*b* is made of stainless with the diameter of 16 millimeters. The resistance layer 22*a* is a [JIS-A] rubber that is made of an NBR/ECO copolymer and has hardness of 40 to 60 degrees, and its resistance was adjusted to three levels based on a compounding ratio of NBR and ECO. The surface layer 22*c* is made of fluorine-containing urethane elastomer with a thickness of 8 micrometers to 24 micrometers, and its resistance was adjusted to three levels based on a type and a dispersion ratio of carbon.

Desirably, the surface layer 22*c* of the secondary transfer roller 22 has a thickness of 8 micrometers to 24 micrometers. That is because the surface layer 22*c* of the secondary transfer roller 22 is often manufactured in a coating process. When a thickness of the surface layer 22*c* is not greater than 8 micrometers, an influence of irregularities in resistance due to unevenness of coating is large, and leak may occur at a position where the resistance is low. Therefore, the thickness that is not greater than 8 micrometers is not preferable. A problem that a surface of the secondary transfer roller 22 gets wrinkled and the surface layer 22*c* is cracked is also apt to occur. On the other hand, when the thickness of the surface layer 22*c* becomes 24 micrometers or above, the resistance is increased. If the volume resistance is high, a voltage when a constant current is applied to the repulsive roller core 16*b* may rise and exceeds a voltage variable range of the constant current power supply 13, and hence a current that is not greater than a target current may be provided. Alternatively, when the voltage variable range is sufficiently high, a leak that arises at a position different from that of the leak as a problem to be solved by the present invention (abnormal discharge (leak) explained in connection with FIGS. 3 and 7) readily occurs due to a high-voltage path from the constant current power supply 13 to the repulsive roller core 16*b* or a high voltage provided in the repulsive roller core 16*b*. Another problem is that the hardness is increased and contact with respect to the recording medium (e.g., paper sheet) S or the intermediate transfer belt 11 is deteriorated when a thickness of the surface layer 22*c* of the secondary transfer roller 22 exceeds 24 micrometers.

The surface layer 22*c* of the secondary transfer roller 22 is made of fluorine-containing urethane elastomer having a thickness of 8 micrometers to 24 micrometers, and its resistance is adjusted to three levels based on a type and a dispersion ratio of a carbon.

More specifically, a volume resistance of a material (fluorine-containing urethane elastomer) alone of the surface layer 22*c* was adjusted to three levels of $10^8$ ohm centimeters, $10^{10}$ ohm centimeters, and $10^{12}$ ohm centimeters. Each of these values is a value obtained by applying the surface layer material alone to, e.g., a stainless steel sheet and measuring a volume resistance by using Hiresta-IP manufactured by Mitsubishi Chemical Corporation conforming to JIS measurement.

The three levels of the resistance of the resistance layer 22*a* were appropriately combined with the three levels of the resistance of the surface layer 22*c* to manufacture the secondary transfer rollers 22 by way of trial based on the following expression:

Three levels of the resistance of the resistance layer 22*a*×three levels of the resistance of the surface layer 22*c*=nine levels Of the second transfer rollers based on these nine levels, one having both the lowest resistance of the resistance layer 22*a* and the lowest resistance of the surface layer 22*c* is on the same level as the secondary transfer roller according to the conventional technology.

Figure 5:
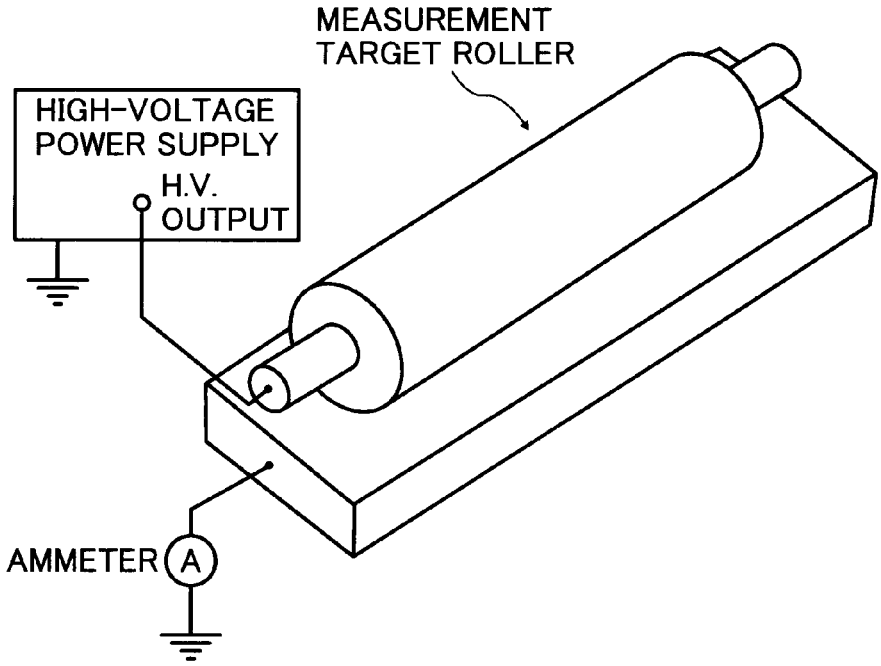
FIG. 5 is a schematic for explaining a method of measuring a volume resistance of a target roller (secondary transfer roller)

As shown in FIG. 5, as a resistance of the secondary transfer roller 22 that is each prototype model, a resistance between the core and the surface of each measurement target roller that is a volume resistance was measured by a method of connecting a direct-current high-voltage power supply with the core of the measurement target roller and measuring a current flowing through a metal sheet that is in contact with the surface layer of the measurement target roller by using an ammeter. That is, the volume resistance is calculated based on the following expression:

Volume resistance [ohm]=high-voltage power supply voltage [volts]/ammeter measured current (amperes)

Figure 6:
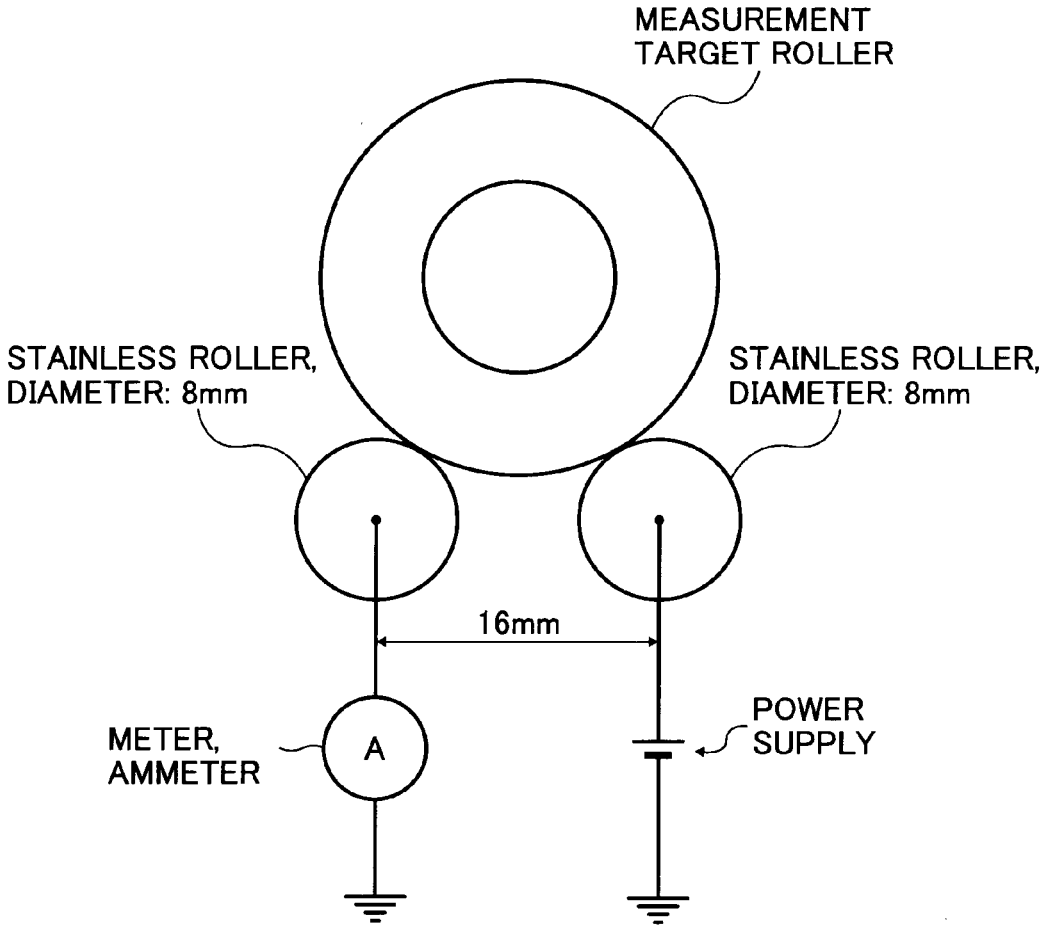
FIG. 6 is a schematic for explaining a method of measuring a surface resistance of the target roller.

As shown in FIG. 6, as a surface resistance, a resistance between the surfaces of each measurement target roller was measured by a method of bringing stainless rollers each having a diameter of 8 millimeters into contact with two positions on the surface layer of the measurement target roller, setting a distance between centers of the two stainless rollers to 16 millimeters, connecting a direct-current high-voltage power supply to one stainless roller, and connecting a meter (ammeter) to the other roller to measure a current flowing through the surface of the measurement target roller. That is, the surface resistance is calculated based on the following expression:

Surface resistance [ohm]=high-voltage power supply voltage [volts]/ammeter measured current (amperes)

The above-explained method is a measurement method used to check each roller as a roller completed product in a nondestructive test, and the surface resistance is different from the resistance of the surface layer measured by Hiresta-IP manufactured by Mitsubishi Chemical Corporation conforming to JIS measurement.

[Leak Test]

Like the states shown in FIGS. 3 and 7, a carbon fiber (charge eliminating brush) having a diameter of approximately 10 micrometers was placed as an electroconductive foreign matter 101 near the charge-eliminating/separating needle 23, and 0 microampere or a bias obtained by superimposing a constant-voltage-controlled AC having a sine wave whose a peak-to-peak value is 8 kV·1 kHz to 12 kV·1 kHz on constant-current-controlled DC having a polarity opposite to that of a toner and a value (equal to or below +10 microamperes) far smaller than that of the secondary transfer bias was applied to the charge-eliminating/separating needle 23. Then, the charge eliminating brush 101 moves to a position near a top of the insulating PC resin guide 24 as a partition plate of the charge-eliminating/separating needle 23 and the secondary transfer roller 22, and stops with a fiber direction facing a direction perpendicular to the secondary transfer roller 22. The charge eliminating brush 101 is considered to be moved to an energetically stable point of an electric field generated by the separation bias. The flash 102 involved by abnormal discharge occurs at both ends of the fiber. The flash is considered to occur when an electric field produced by the separation bias is intensive. When an electric field produced by the separation bias is further intensive, the charge eliminating brush 101 emits light based on heat generation to fuse the peripheral resin guide members 24 and 25. This light is considered as Planck light based on Joule heat generation that occurs when abnormal discharge is transmitted through the carbon fiber.

Figure 4:
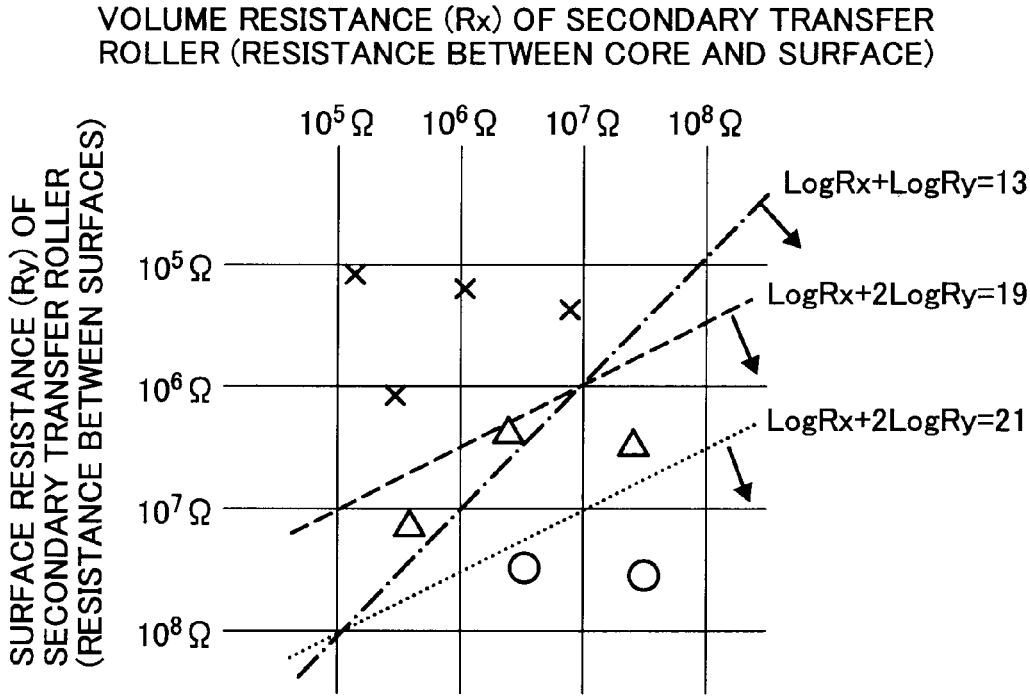
FIG. 4 is a graph of results of a leak test conducted using secondary transfer rollers of nine levels having different volume resistance and surface resistance.

This test was conducted with respect to each of the secondary transfer rollers based on the nine levels, and how far the phenomenon proceeds was observed to make a judgment based on the following criteria. FIG. 4 is a graph of results of the leak test, in which symbols ○, Δ, x are given to points of values obtained by measuring resistance of the secondary transfer rollers.

<Judgments>

○ No flash based on abnormal discharge is observed, and no sign of fusion of the resin is observed.

Δ A flash based on abnormal discharge is observed, but a sign of fusion of the resin is not observed.

x Both a flash based on abnormal discharge and a sign of fusion of the resin are observed.

<Results>

As a result of the judgments, a flash based on abnormal discharge is observed but a sign of fusion of the resin is not observed in a region of Δ as shown in FIG. 4. In a region of ○, a flash based on abnormal discharge is not observed and a sign of fusion of the resin is not observed either. A surface resistance (resistance between the surfaces) of the secondary transfer roller 22 is larger than a volume resistance (resistance between the core and the surface) (namely, when the resistance layer of the secondary transfer roller 22 includes the inner layer 22*a* and the surface layer 22*c*, a resistance of the surface layer 22*c* in the resistance layer is higher than that of the inner layer 22*a* in the same (in other words, a resistance of the surface layer 22*c* in the secondary transfer roller 22 is higher than a volume resistance (resistance between the core and the surface) of the secondary transfer roller 22)). As a result, even if the electroconductive small foreign matter adhering to the recording medium S may be attached to the high-resistance or the insulating guide members 24 and 25 provided between the charge-eliminating/separating needle 23 and the secondary transfer roller 22, abnormal discharge does not occur between the charge-eliminating/separating needle 23 and the secondary transfer roller 22 at all, or it can be suppressed to the minimum level if it occurs. The power supply that supplies a high voltage to the charge eliminating needle can be prevented from coming to an abnormal stop, or the foreign matter can be prevented from being fixed in the resin of each guide member. It is to be noted that abnormal discharge can be avoided when both a resistance of the resistance layer 22*a* and a resistance of the surface layer 22*c* in the secondary transfer roller 22 are high, but the resistance of the surface layer 22*c* has a larger contribution.

<Conclusion>

Considering from the judgment results in FIG. 4, in the transfer-separation device according to the embodiment, a volume resistance (resistance between the core and the surface) of the repulsive roller 16 is higher than a volume resistance (resistance between the core and the surface) of the secondary transfer roller 22, a surface resistance of the secondary transfer roller 22 is set to $10^{6.5}$ ohm or above, and a volume resistance of the surface layer 22*c* of the secondary transfer roller 22 is set to $10^{10}$ ohm centimeters or above. More preferably, the volume resistance of the surface layer 22*c* of the secondary transfer roller 22 is set to $10^{12}$ ohm centimeters or above.

In the transfer-separation device according to the embodiment, the volume resistance of the repulsive roller 16 is set to $10^7$ ohm to $10^9$ ohm.

In the transfer-separation device according to the embodiment, assuming that Rx is the volume resistance of the secondary transfer roller 22 and Ry is the surface resistance of the secondary transfer roller 22, satisfying the following relationship can suffice:

$$\text{Log } Rx + \text{Log } Ry \geqq 13$$

Alternatively, satisfying the following relationship can suffice:

$$\text{Log } Rx + 2 \text{ Log } Ry \geqq 19$$

More preferably, the following relationship is satisfied:

$$\text{Log } Rx + 2 \text{ Log } Ry \leqq 21$$

In the transfer-separation device according to the embodiment, when the volume resistance of the repulsive roller 16 is increased and the volume resistance of the secondary transfer roller 22 is reduced, a current that leaks through the intermediate transfer belt 11 is eliminated, and a current applied to the repulsive roller 16 becomes a transfer current flowing toward the recording medium S from the intermediate transfer belt 11 as it is. Thus, a transfer ratio is stabilized. When the resistance between the core of the repulsive roller and the core of the secondary transfer roller is increased, a voltage of the secondary transfer bias applied to the core of the repulsive roller can be suppressed from being increased.

When the volume resistance (resistance between the core and the surface) of the secondary transfer roller 22 is increased, it approximates the volume resistance (resistance between the core and the surface) of the repulsive roller 16 (or turns back). Therefore, increasing the resistance between the core of the repulsive roller and the core of the secondary transfer roller heightens the voltage of the secondary transfer bias applied to the core of the repulsive roller, which is not preferable. Since the resistance of the surface layer 22*c* of the secondary transfer roller 22 greatly contributes to prevention of abnormal discharge, increasing the resistance of the surface layer 22*c* alone without greatly increasing the volume resistance of the resistance layer 22*a* of the secondary transfer roller 22 is desirable. Therefore, when the volume resistance of the repulsive roller 16 is $10^7$ ohm or above, the volume resistance (resistance between the core and the surface) of the secondary transfer roller 22 is set to $10^6$ ohm to $10^7$ ohm, the surface resistance (resistance between the surfaces) of the same is set to $10^7$ ohm to $10^8$ ohm, and the volume resistance of the surface layer 22*c* alone is set to $10^{10}$ ohm centimeters or above. More preferably, setting this volume resistance to $10^{12}$ ohm centimeters or above is desirable. Both avoidance of abnormal discharge and stabilization of a transfer ratio can be achieved.

As set forth hereinabove, according to an embodiment of the present invention, a volume resistance of the repulsive roller (resistance between the core and the surface) is higher than a volume resistance of the secondary transfer roller (resistance between the core and the surface), and the secondary transfer roller has a surface resistance (resistance between the surfaces) higher than the volume resistance (resistance between the core and the surface). Alternatively, the secondary transfer roller has a resistance layer, the resistance layer is formed of at least two layers, and the resistance layer has a surface layer whose resistance is higher than that of an inner layer. As a result, even if an electroconductive small foreign matter adhering to the recording medium is attached to the high-resistance or the insulating guide member provided between the charge eliminating member and the secondary transfer roller, abnormal discharge between the charge-eliminating/separating member does not occur at all. Even if this abnormal discharge occurs, it can be minimally restrained. Thus, it is possible to avoid abnormal stop of the power supply that supplies a high voltage to the charge eliminating member or preventing the foreign matter from being fixed in a resin of the guide member.

Moreover, according to another embodiment of the present invention, when a resistance of the repulsive roller constituting the transferring unit is increased and a resistance of the secondary transfer roller is reduced, a current that leaks through the intermediate transfer member is no longer present, and a current applied to the repulsive roller directly becomes a transfer current flowing toward the recording medium from the intermediate transfer member, which stabilizes a transfer ratio. Zero microampere or a bias obtained by superimposing an AC on a constant-current-controlled DC that has a polarity opposite to that of a toner and a value far smaller than that of a secondary transfer bias is applied to the charge-eliminating/separating member placed at a position closer to the secondary transfer roller than the intermediate transfer member, an abnormal image due to discharge for separation and charge elimination can be avoided, and an interference of the current and a secondary transfer current due to discharge for separation and charge elimination can be suppressed. Thus, the transfer-separation device having a stabilized transfer ratio can be realized. In the image forming apparatus including the transfer-separation device, even if an electroconductive foreign matter adheres to a charge-eliminating/separating needle, abnormal discharge can be avoided, and the image forming apparatus no longer abnormally stops, thus eliminating maintenance for the attached foreign matter.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer-separation device comprising:

an intermediate transfer unit that is in a shape of an endless belt, onto which a toner image is primarily transferred from an image carrier;

a secondary transfer roller that is in contact with a surface of the intermediate transfer unit where the toner image is carried via a recording medium, the secondary transfer roller including a core and a resistance layer, wherein the resistance layer includes an inner layer formed outside the core and a surface layer formed outside the inner layer, and a resistance of the surface layer, which is a surface resistance between two separate surface portions on the surface layer, is configured to be higher than a resistance of the inner layer, which is a volume resistance between the core and the outer surface of the surface layer;

a repulsive roller that is located opposite to the secondary transfer roller and, with the secondary transfer roller, forms a secondary transfer nip through which the intermediate transfer unit and the recording medium pass;

a transfer unit that applies a bias voltage of a polarity identical to a polarity of the toner image to the repulsive roller to generate a transfer electric field, and secondarily transfers the toner image onto the recording medium; and a charge-eliminating and separating member that is located downstream of the secondary transfer nip in a conveying direction of the recording medium, and eliminates charge from a surface of the recording medium to separate the recording medium from the intermediate transfer unit, wherein a resistance of the repulsive roller is greater than a resistance of the secondary transfer roller, and the surface resistance of the secondary transfer roller is equal to or greater than $10^{6.5}$ ohm.

2. The transfer-separation device according to claim 1, wherein a volume resistance of the surface layer of the secondary transfer roller is equal to or greater than $10^{12}$ ohm centimeters.

3. The transfer-separation device according to claim 1, wherein the volume resistance of the repulsive roller is in a range of $10^7$ ohm to $10^9$ ohm.

4. The transfer-separation device according to claim 3, wherein the resistance and the surface resistance of the secondary transfer roller satisfy:

$$\text{Log } Rx + \text{Log } Ry \geqq 13$$

where Rx is the resistance and Ry is the surface resistance.

5. The transfer-separation device according to claim 3, wherein the resistance and the surface resistance of the secondary transfer roller satisfy:

$$\text{Log } Rx + 2 \text{ Log } Ry \geqq 21$$

where Rx is the resistance and Ry is the surface resistance.

6. The transfer-separation device according to claim 3, wherein the resistance and the surface resistance of the secondary transfer roller satisfy:

$$\text{Log } Rx + 2 \text{ Log } Ry \geqq 21$$

where Rx is the resistance and Ry is the surface resistance.

7. The transfer-separation device according to claim 1, wherein a volume resistance of the surface layer of the secondary transfer roller is equal to or greater than $10^{10}$ ohm centimeters.

8. An image forming apparatus comprising:

an image carrier that carries a toner image; and a transfer-separation device that includes an intermediate transfer unit that is in a shape of an endless belt, onto which a toner image is primarily transferred from the image carrier;

a secondary transfer roller that is in contact with a surface of the intermediate transfer unit where the toner image is carried via a recording medium, the secondary transfer roller including a core and a resistance layer, wherein the resistance layer includes an inner layer formed outside the core and a surface layer formed outside the inner layer, and a resistance of the surface layer, which is a surface resistance between two separate surface portions on the surface layer, is configured to be higher than a resistance of the inner layer, which is a volume resistance between the core and the outer surface of the surface layer;

a repulsive roller that is located opposite to the secondary transfer roller and, with the secondary transfer roller, forms a secondary transfer nip through which the intermediate transfer unit and the recording medium pass;

a transfer unit that applies a bias voltage of a polarity identical to a polarity of the toner image to the repulsive roller to generate a transfer electric field, and secondarily transfers the toner image onto the recording medium; and a charge-eliminating and separating member that is located downstream of the secondary transfer nip in a conveying direction of the recording medium, and eliminates charge from a surface of the recording medium to separate the recording medium from the intermediate transfer unit, wherein a resistance of the repulsive roller is greater than a resistance of the secondary transfer roller, and the surface resistance of the secondary transfer roller is equal to or greater than $10^{6.5}$ ohm.

* * * * *